US007245859B2

(12) United States Patent
Kabai et al.

(10) Patent No.: US 7,245,859 B2
(45) Date of Patent: Jul. 17, 2007

(54) IMAGE FORMING APPARATUS HAVING A ROTARY DEVELOPING DEVICE WITH PLURAL DEVELOPING UNITS

(75) Inventors: Takahito Kabai, Mishima (JP); Satoshi Itaya, Mishima (JP); Mitsuhisa Kato, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 127 days.

(21) Appl. No.: 11/154,802

(22) Filed: Jun. 17, 2005

(65) Prior Publication Data

US 2006/0285884 A1 Dec. 21, 2006

(51) Int. Cl.
*G03G 15/01* (2006.01)

(52) U.S. Cl. ..... 399/227

(58) Field of Classification Search ..... 399/227, 399/98, 99, 107, 222, 252
See application file for complete search history.

(56) References Cited

U.S. PATENT DOCUMENTS

2004/0062570 A1* 4/2004 Hachisuga ..... 399/227 X
2004/0190942 A1* 9/2004 Iino ..... 399/227
2006/0269328 A1* 11/2006 Ochiai ..... 399/227 X

FOREIGN PATENT DOCUMENTS

JP 58-156969 A * 9/1983
JP 02-046469 A 2/1990
JP 11-305543 A 11/1999
JP 2000-267346 A 9/2000

* cited by examiner

*Primary Examiner*—Sophia S. Chen
(74) *Attorney, Agent, or Firm*—Foley & Lardner LLP

(57) ABSTRACT

An image-forming apparatus includes a rotary developing device including a casing having absolute value of the surface potential of not larger than 300 V.

19 Claims, 1 Drawing Sheet

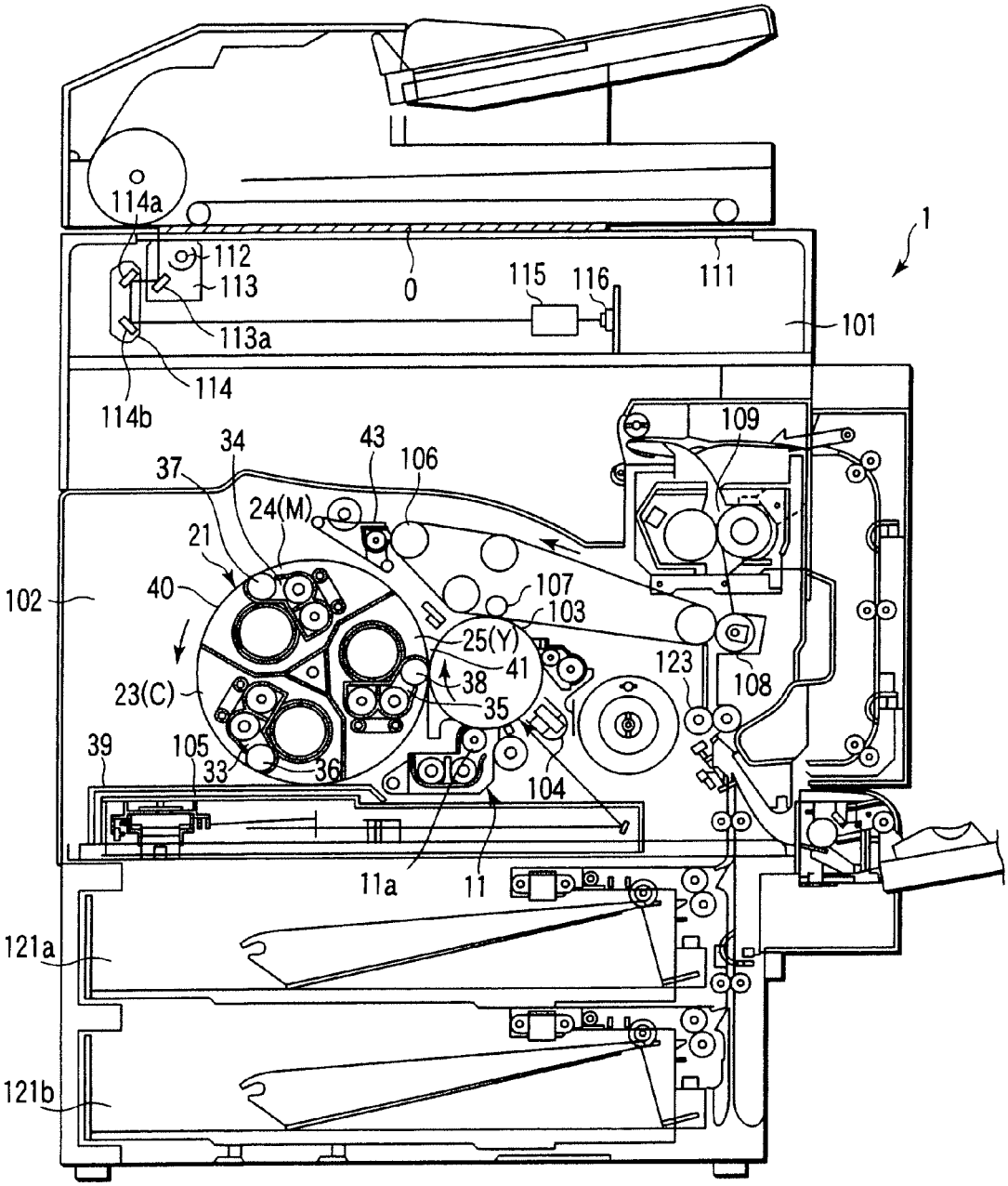
114a
112
113
113a
114
114b
0
115
116
111
1
101
109
34
43
106
37
24(M)
21
40
102
107
103
25(Y)
41
38
35
23(C)
123
108
39
105
33
36
104
11a
11
121a
121b

IMAGE FORMING APPARATUS HAVING A ROTARY DEVELOPING DEVICE WITH PLURAL DEVELOPING UNITS

BACKGROUND OF THE INVENTION

The present invention relates to an image-forming apparatus for developing an electrostatic latent image or a magnetic latent image in the electrophotographic method and the electrostatic printing method, particularly, to an image-forming apparatus comprising a rotary developing device in which a plurality of developing units arranged around the axis are rotated so as to bring the desired developing unit to a developing position.

In the rotary developing device, toner is scattered from the open portion of the rotating developing unit so as to be accumulated in, for example, the region in which the developing device, the photosensitive body and the intermediate transfer member are positioned adjacent to each other. A large amount of the toner thus accumulated is dropped so as to give rise to the problem that an undesired portion within the image-forming apparatus is contaminated with the dropping toner, thereby forming a defective toner image. To avoid the difficulty, a toner receptacle is arranged so as to recover the scattered toner, as disclosed in, for example, Japanese Patent Disclosure (Kokai) No. 11-305543.

However, the toner is frictionally charged within each developing unit, with the result that the surface of the casing covering the rotary developing device tends to be charged and, thus, the toner that was scattered and accumulated within the casing tends to be attached to the surface of the casing. If the developing device is rotated under this state, vibration of the developing device causes the attached toner to drop from the casing surface so as to further scatter the toner, thereby contaminating the image-forming regions such as the image carrier and the intermediate transfer member.

It was customary in the past to arrange a recovery roller at the positions where the toner tends to be scattered so as to recover the scattered toner or to arrange a sucking device for recovering the scattered toner. However, these recovery methods cause the image-forming apparatus to be come complex in construction, and to be made bulky. In addition, the manufacturing cost of the image-forming apparatus is increased.

BRIEF SUMMARY OF THE INVENTION

An object of the present invention, which has been achieved in view of the situation described above, is to provide an image-forming apparatus, which permits suppressing the toner scattering within the image-forming apparatus comprising a rotary developing device, which facilitates the recovery of the scattered toner, and which also permits forming a satisfactory toner image free from image defects.

According to the present invention, there is provided an image-forming apparatus, comprising:

an image carrier;

a developing section equipped with a rotary developing device (revolver type developing device) including a plurality of developing units formed on the image carrier and arranged rotatable around the axis, each developing unit having a region for holding a developing agent and a developing agent-carrying member for supplying the developing agent onto the electrostatic latent image formed on the image carrier, and a casing having the plural developing units housed therein and including open sections partly exposing the developing agent-carrying members, the absolute value of the surface potential of the casing being not larger than 300 V;

a transfer section for transferring a developing agent image formed in the developing section onto a recording medium; and a fixing section for fixing the transferred developing agent image to the recording medium.

Further, according to the present invention, there is provided an image-forming method, comprising the steps of:

forming an electrostatic latent image on an image carrier;

arranging an rotary developing device including a plurality of developing units each having a developing agent-carrying member for supplying the developing agent, the plural developing units being arranged rotatable about the axis, and a casing having the plural developing units housed therein and including open sections exposing partly the developing agent-carrying members of the developing units, the absolute value of the surface potential of the casing being not larger than 300 V, and the rotary developing device being arranged such that one of the developing units is positioned to face the image carrier so as to supply the developing agent onto the electrostatic latent image formed on the image carrier so as to form a developing agent image;

transferring the developing agent image formed in the developing section onto a recording medium; and fixing the developing agent image transferred onto the recording medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The FIGURE schematically shows as an example the construction of an image-forming apparatus according to one embodiment of the present invention.

DETAILED DESCRIPTION OF THE INVENTION

The image-forming apparatus of the present invention comprises an image carrier; a developing section arranged on the image carrier and including a plurality of developing units arranged to be rotatable around the axis, each developing unit having a developing agent-holding region and a developing agent-carrying member for supplying a developing agent onto the latent image formed on the image carrier, and a casing having the plural developing units housed therein and including open sections partly exposing the developing agent-carrying members; a transfer section for transferring a developing agent image formed in the developing section onto a recording medium; and a fixing section for fixing the developing agent image transferred onto the recording medium, wherein the absolute value of the surface potential of the casing is not larger than 300 V.

Also, the image-forming method of the present invention comprises the steps of forming an electrostatic latent image on an image carrier; arranging the rotary developing device such that one of the developing units included in the rotary developing device is positioned to face the image carrier so as to supply a developing agent onto the electrostatic latent image formed on the image carrier, thereby forming a developing agent image; transferring the developing agent image formed in the developing section onto a recording medium; and fixing the developing agent image transferred onto the recording medium.

According to the present invention, a conductive material is used for forming the casing of the rotary developing device so as to lower the absolute value of the surface potential of the casing to 300 V or less. As a result, it is possible to prevent the casing surface from being charged. Even if the scattered toner is attached to the casing surface having a low degree of charging, the electrostatic attaching force of the scattered toner to the casing surface is relatively small. As a result, the scattered toner is dropped downward in accordance with rotation of the rotary developing device without being accumulated on the casing surface. If the scattered toner is not attached to and accumulated on the casing of the rotary developing device, the scattered toner is prevented from being spread by the rotation of the rotary developing device. It follows that the scattered toner can be recovered easily.

As described above, the present invention provides a high-quality full-color image-forming apparatus, which permits preventing an image defect caused by the scattered toner without arranging a costly recovery means of the scattered toner. In addition, the image-forming apparatus of the present invention can be manufactured at a low cost.

The present invention will now be described in detail with reference to the accompanying drawing.

The FIGURE schematically shows as an example the construction of an image-forming apparatus according to one embodiment of the present invention.

In the copying apparatus 1 shown in The FIGURE, an original O to be copied is disposed in a prescribed position on an original table 111 in copying the image information of the original. The original O is scanned by a scanning section 101.

If the start-up of the copying operation is instructed from an operation panel (not shown), an illuminating lamp 112 is lit so as to emit an illuminating light having a prescribed light intensity.

First and second carriages 113 and 114 are moved along the original table 111 at a prescribed moving speed that is determined in accordance with the copying magnification. As a result, the image information of the original O set on the original table 111 is illuminated successively by the illuminating light emitted from the illuminating lamp 112.

The light reflected from the object to be copied contains the image information in the form of the degree of brightness of the light. The reflected light is called herein image light.

The image light is reflected by an image take-out mirror 113*a* fixed to the first image carriage 113 toward the second carriage 114 and, then, further reflected by a first mirror 114*a* and a second mirror 114*b* mounted within the second carriage 114 so as to be incident on an image-forming lens 115.

The image light incident on the image-forming lens 115 forms an image on the light-receiving plane of a CCD sensor 116.

The image light forming the image on the CCD sensor 116 is successively subjected to the photoelectric conversion by three line sensors of, for example, red (R), green (G) and blue (B) images, which are complementary colors of cyan (C), magenta (M) and yellow (Y), respectively, or by four line sensors of R, G, B and black (B), and the result of the photoelectric conversion is obtained as an output at a prescribed timing.

In an image forming section 102, an exposing light having the intensity modulated based on the output subjected to the photoelectric conversion by the CCD sensor 116, i.e., based on an image signal, is emitted from an exposure device 105 so as to illuminate a prescribed position of a photoreceptor drum 103 having a diameter of, for example, 90 mm. As a result, a latent image conforming with the intensity of the exposing light is formed on the photoreceptor drum 103 whose surface has been charged by charger 104.

A black toner for forming a Bk image is supplied from a Bk developing device 11 onto the photoreceptor drum 103 so as to form a black toner image, thereby making visible the latent image formed on the photoreceptor drum 103. Alternatively, colored toners of C, M and Y collectively forming a color image are selectively supplied from a rotary (revolver type) developing device 21 onto the photoreceptor drum 103 so as to form a colored toner image on the photoreceptor drum 103, thereby making visible the latent image formed on the photoreceptor drum 103.

The rotary developing device 21 includes developing units 23, 24 and 25 for developing the three colors of C, M, Y, respectively, which are arranged to be rotatable around the axis of the rotary developing device 21. The developing units 23, 24 and 25 include a toner holding regions 33, 34 and 35 for holding three colors of toners C, M, and Y and a developing rollers 36, 37 and 38. Still further, the developing units 23, 24 and 25 have open portions partially exposing the developing rollers 36, 37 and 38, respectively, and are housed in a casing 40 covering the outer circumferential regions of the developing units 23, 24, 25. The casing 40 is formed of a conductive material and is formed such that the absolute value of the surface potential of the casing 40 is not larger than 300 V. A detachable recovery tray 39 for recovering the toner dropping from the rotary developing device 21 is arranged below the rotary developing device 21.

A reference numeral 41 denotes a region in which the toner scattering is likely to be generated. The toner scattering region 41 is positioned immediately downstream of the region in which the developing roller is exposed through the open section so as to carry out the development. In the embodiment shown in the drawing, the toner tends to be scattered in accordance with rotation of, for example, the developing roller 38 within the rotary developing device 21. If the casing 40 is charged, the scattered toner tends to be attached to the surface of the casing 40. If the attached amount of the toner is increased, the attached toner is caused to be instantly released from the surface of the casing 40 by the vibration accompanying the rotation of the rotary developing device 21. As a result, the toner released from the surface of the casing 40 is transferred onto the image formed on the photoreceptor drum 103 and a transfer belt 106 so as to bring about an image defect.

In the present invention, however, the absolute value of the surface potential of the casing 40 is not larger than 300 V and, thus, the surface of the casing 40 is unlikely to be charged. As a result, the scattered toner is unlikely to be attached to the surface of the casing 40. Such being the situation, the scattered toner is not spread to reach the photoreceptor drum 103 and the transfer belt 106 before the toner attached to the surface of the casing 40 is accumulated in a large amount so as to make it possible to easily recover the scattered toner in a region apart from the image-forming section, i.e., to recover the scattered toner in, for example, a recovery tray 39. Also, since the scattered toner is recovered in the recovery tray 39, it is possible to prevent the image from being stained or to prevent the apparatus body from being broken.

It is possible for the rotary developing device 21 and the Bk developing device 11 to be operated, for example, as follows.

Where an image formation using the rotary developing device 21 is instructed, it is possible for the Bk developing device 11 to be moved to a Bk retreat (color developing) position where the photoreceptor drum 103 is not in contact with the developing roller 11*a*. Incidentally, in the color developing (Bk retreat) position, the Bk developing device 11 is moved to a position between the photoreceptor drum 103 and the developing roller 11*a*, this position being sufficiently apart from the surface of the photoreceptor drum 103 to prevent the toner scattered from the developing roller 11*a* from being attached electrostatically to the latent image formed on the photoreceptor drum 103.

The toner image formed on the photoreceptor drum 103 is transferred in accordance with rotation of the photoreceptor drum 103 to an intermediate transfer position at which the transfer belt (intermediate transfer body) 106 is allowed to face the photoreceptor drum 103.

The toner image formed on the photoreceptor drum 103 transferred to the intermediate transfer position is transferred onto the transfer belt 106 by an intermediate transfer voltage supplied from an intermediate transfer device 107.

The toner image transferred onto the transfer belt 106 is transferred to a region at which a transfer device 108 faces the transfer belt 106 so as to permit the toner image to be transferred onto a paper sheet used as a recording material because a prescribed transfer voltage is generated from the transfer device 108. The paper sheet is taken up from a cassette 121*a* or 121*b* at a prescribed timing so as to be transferred into the transfer position with the timing aligned with the position of the toner image formed on the photoreceptor drum 103 by an aligning roller 123. Incidentally, a colored paper sheet or a transparent resin sheet can also be used, as desired, as the recording material. Also, it is possible to mount a cleaning mechanism 43 on the transfer belt 106.

The paper sheet having the toner image transferred thereonto is transferred into a fixing device 109, and a prescribed heat is supplied from the fixing device 109 onto the paper sheet. As a result, the toner image is melted and fixed to the paper sheet.

In the machine described above, the Bk developing device is arranged separately from the rotary developing device. However, it is also possible for four developing units each developing a single color image of C, M, Y and Bk to be arranged within the rotary developing device.

In the present invention, the material used for forming the casing is limited such that the absolute value of the surface potential of the casing is not larger than 300 V.

To be more specific, it is possible for the casing to be formed of an integral housing member capable of housing two or more of developing units. It is also possible for a cartridge container housing, for example, a developing agent to be incorporated into the outer circumferential portion of the housing member noted above so as to constitute a part of the surface of the casing.

It is desirable for the casing to contain or to be covered with a conductive material. To be more specific, it is possible to use in combination a resin material and a conductive material as a material of the casing. Alternatively, it is possible to mix a conductive material with a resin material for forming the casing. Further, it is also possible to cover the casing formed of a resin material with a conductive material.

The resin material used for forming the casing includes, for example, polystyrene, polyethylene, polypropylene, polyacetal, polycarbonate and acrylonitrile-butadiene-styrene.

The conductive material used for forming the casing includes, for example, carbon fiber, stainless steel fiber, metal foil such as a tape-like copper foil, and conductive polymer having a polar group.

Since carbon fiber, stainless steel fiber, metal tape, etc., exhibit conductivity, it is possible to prevent the casing surface from being charged.

Also, the conductive polymer having a polar group permits releasing the accumulated charge into the air via the water molecules in the air.

It is desirable for the region below the rotary developing device to be constructed in view of the cleaning capability of the scattered toner. For example, the particular region should be detachable. It is also desirable to arrange a tray or a sheet below the rotary developing device. Further, it is desirable for the tray or sheet to be formed of a resin material having a high releasability such as polyoxymethylene (POM), phenol formaldehyde (PFA), or polytetrafluoro ethylene (PTFE).

The developing agent according to the present invention comprises a toner containing a coloring agent and bonder resin.

The toner comprises toner particles containing a coloring agent and a binder resin, and an additive added to the surface of the toner particles.

The additive used in the present invention includes, for example, silica and titanium oxide. Silica and titanium oxide can be subjected to the hydrophobic treatment by using, for example, a silane coupling agent or a silicone oil. Also, a surface treatment can be applied to silica and titanium oxide by using a conductive material including, for example, $SnO_2$—Sb.

In the present invention, it is desirable to use as the additive titanium oxide subjected to a hydrophobic treatment and/or oxide particles subjected to a surface treatment with a conductive material. The metal oxides subjected to the surface treatment with a conductive material include, for example, EC300 and ES650 manufactured by Titan Kogyo K.K.

The additive described above permits lowering the surface potential of the casing. In addition, the particular additive permits preventing more effectively the scattered toner from being attached to the surface of the casing.

The coloring agent used in the present invention includes, for example, carbon black, copper phthalocyanine, disazo yellow, monoazo yellow, bensimidazolone, naphthol AS, quinacridone, and Carmine 6B.

The binder resin used in the present invention includes, for example, polyester, styrene acrylate, epoxy, polyethylene, polypropylene, and ethylene norbornene.

EXAMPLES

The present invention will now be described more in detail with reference to Examples of the present invention.

Examples 1 to 3 and Comparative Examples 1 to 3

Toner particle materials of the composition given below were prepared so as to prepare toner particles.

Manufacture of Toner

The toner particle materials given below were kneaded by using a biaxial continuous kneader, followed by processing the kneaded material in a collision type pulverizer and, then, in a gaseous flow classifier to obtain toner particles for each color having a particle diameter of 8 μm.

Further, 1.5% by weight of silica subjected to the hydrophobic treatment was added as an additive to the surfaces of the toner particles thus obtained, followed by mixing the resultant materials in a Henschel mixer (manufactured by Mitsui Kozan K.K.) to obtain the toner.

Still further, a ferrite carrier coated with a silicone resin was mixed with the toner thus obtained at a mixing ratio of 8:92 to obtain a developing agent having a charged amount of about 30 (μC/g).

| Toner particle materials | | |
|---|---|---|
| | Yellow toner composition: | |
| Binder resin | Polyester resin | 92% by weight |
| Pigment | Pigment yellow 180 | 4% by weight |
| Wax | Rice wax | 3% by weight |
| CCA | Zirconia complex | 1% by weight |
| | Magenta toner composition: | |
| Binder resin | Polyester resin | 90% by weight |
| Pigment | Magenta pigment Pigment red 122 | 6% by weight |
| Wax | Rice wax | 3% by weight |
| CCA | Zirconia complex | 1% by weight |
| | Cyan toner composition: | |
| Binder resin | Polyester resin | 92% by weight |
| Pigment | Cyan pigment Pigment blue 15-3 | 4% by weight |
| Wax | Rice wax | 3% by weight |
| CCA | Zirconia complex | 1% by weight |
| | Black toner composition: | |
| Binder resin | Polyester resin | 92% by weight |
| Pigment | Black pigment (carbon black) | 4% by weight |
| Wax | Rice wax | 3% by weight |
| CCA | Zirconia complex | 1% by weight |

Further, an image was formed by using an image-forming apparatus (multifunction copying machine e-Studio-3511 manufactured by Toshiba Tec. K.K.) constructed as shown in The FIGURE, except that the material used for forming the casing was changed as shown in Table 1 and the toners manufactured as above were used.

The surface potential of the casing and the amount of the toner attached to the surface of the casing during the copying operation were measured.

For measuring the attached amount of toner, the toner attached to the surface of the casing was wiped off with a cotton, and the attached amount was obtained by measuring the difference in weight between the cotton before the wiping of the toner and the cotton after the wiping of the toner. The toner attached amount was evaluated based on the difference in weight noted above. Specifically, the toner attached amount was evaluated "negligible" in the case where the difference in weight was smaller than 1 gram, "very small" in the case where the difference in weight was 1 to 2 grams, "small" in the case where the difference in weight was larger than 2 grams and not larger than 6 grams, and "large" in the case where the difference in weight exceeded 6 grams.

Further, image defects at the time of obtaining 45,000 copies was visually examined.

Table 1 shows the results.

TABLE 1

| | Casing material | Surface potential during copying operation | Amount of toner attached to casing | Image defect at the time of obtaining 45,000 copies |
|---|---|---|---|---|
| Comparative Example 1 | Polystyrene | 200–1300 V (unstable) | Large | Occurrence |
| Comparative Example 2 | ABS mixed with surfactant | 600 V | Small | none |
| Comparative Example 3 | Polystyrene having the surface coated with surfactant | 300 V | Very small | none |
| Example 1 | Polypropylene mixed with carbon fiber | 300 V | Very small | none |
| Example 2 | Polypropylene mixed with stainless steel fiber | 300 V | Very small | none |
| Example 3 | Polystyrene covered with copper tape | 200 V | Very small | none |

As apparent from Table 1, it was possible to prevent static electricity from being accumulated on the surface of the casing so as to stabilize and lower the surface potential of the casing by selecting appropriately the material used for forming the surface of the casing as in Examples 1 to 3. As a result, it was possible to suppress the amount of the scattered toner attached to the surface of the casing. The effect of lowering the surface potential was not dependent on temperature, and the particular effect could be maintained permanently without being impaired by cleaning within the copying machine and by erroneous operation of the copying machine.

However, the surface potential during the copying operation was high in Comparative Examples 1 and 2, indicating that the amount of toner attached to the surface of the casing was increased during the copying operation. It is considered reasonable to understand that the toner scattered from the open portion of the casing is not charged sufficiently and, thus, if a region having a high surface potential is included in the surface of the casing, the scattered toner is electrostatically attracted to the region having a high surface potential regardless of the polarity of the high surface potential region.

In Comparative Example 2, a surfactant is mixed in, for example, an acrylonitrile-butadiene-styrene resin. In this case, the hydrophilic group and the functional group of the surfactant attracts the water molecules in the air and releases the electric charge into the air via the water molecules so as to stabilize and lower the surface potential of the casing. However, the lowering of the surface potential was not sufficient for decreasing the amount of toner attached to the surface of the casing. The surfactant that can be used includes, for example, "Elestmaster" manufactured by Kao K.K. and "Armostat" manufactured by Lion K.K.

The material corresponding to Comparative Example 3 includes, for example, "Elegard" manufactured by Lion K.K. Also, as apparent from Comparative Examples 2 and 3, in the case of using a surfactant and a polymer material having a functional group, it is impossible in some cases to obtain a desired effect sufficiently because of the influence of humidity and the change with time in the properties of the surfactant and the polymer material. In general, the temperature within the electrophotographic apparatus is changed depending on the environment under which the apparatus is used and depending on the fixing device so as to lower the humidity, resulting in failure for the surfactant, etc., to produce its effect of suppressing the static electricity sufficiently in some cases.

It can also be considered that, when the inner regions of various machines are cleaned for removing the stain, etc., it is possible for the surfactant on the surface of the casing to be wiped off. It follows that it is difficult to maintain the effect of lowering the surface potential semi-permanently in Comparative Examples 2 and 3.

Examples 4 to 9

Developing agents were obtained as in Example 1, except that additives shown in Table 2 were added to the surfaces of the toner particles used in Example 1.

Also, a silicone resin-coating agent of a carrier was prepared. In this case, all of the developing agents obtained exhibited a charged amount of about 25 (μC/g).

Image formation was carried out as in Example 1 by using the developing agents thus obtained so as to examine the amount of the toner attached to the surface of the casing and the image defect.

Table 2 also shows the experimental data.

TABLE 2

| | Additive 1 | Additive 2 | Amount of toner attached to casing | Image defect at the time of obtaining 45,000 copies |
|---|---|---|---|---|
| Example 4 | Silica subjected to hydrophobic treatment = 1% | Silica (Nippon Aerosil R972) = 0.5% | Very small | None |
| Example 5 | Silica subjected to hydrophobic treatment = 1% | Silica (Nippon Aerosil RX200) = 0.5% | Very small | None |
| Example 6 | Silica subjected to hydrophobic treatment = 1% | Titanium oxide treated with a silane coupling agent (rutile type) = 0.5% | Negligible | None |
| Example 7 | Silica subjected to hydrophobic treatment = 1% | Titanium oxide treated with a silane coupling agent (rutile/anatase mixed crystal type) = 0.5% | Negligible | None |
| Example 8 | Silica subjected to hydrophobic treatment = 1% | Conductive silica = 0.5% | Negligible | None |
| Example 9 | Silica subjected to hydrophobic treatment = 1% | Conductive titanium oxide = 0.5% | Negligible | None |

The "conductive silica" indicated in Table 2 denotes the silica treated with $SnO_2$—Sb so as to have the conductivity imparted thereto. Also, "conductive titanium oxide" indicated in Table 2 denotes the titanium oxide treated with $SnO_2$—Sb so as to have the conductivity imparted thereto.

As shown in Table 2, a hydrophobic silica and another silica were used in combination as additives in Examples 4 and 5. In these Examples, the absolute value of the surface potential of the casing was lowered to 300 V or less, with the result that the attaching force of the toner to the casing surface was sufficiently lowered so as to make it possible to obtain an image free from image defects.

Also, in Examples 6 and 7, a hydrophobic silica and titanium oxide having a good conductivity were used in combination as additives having a low resistivity so as to lower the resistance of the toner surface. It has been found that, in these Examples, it was possible to further decrease the amount of toner attached to the surface of the casing so as to make it possible to obtain a satisfactory image free from image defects.

Further, in Examples 8 and 9, a hydrophobic silica was used in combination with a conductive silica or a conductive titanium oxide as additives. It has been found that it was possible to further decrease the amount of the toner attached to the surface of the casing in these Examples, too, so as to make it possible to obtain a satisfactory image free from image defects.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image-forming apparatus, comprising:

an image carrier;

a developing section equipped with a rotary developing device including a plurality of developing units formed on the image carrier and arranged rotatable around an axis, each developing unit having a region for holding a developing agent and a developing agent-carrying member for supplying the developing agent onto an electrostatic latent image formed on the image carrier to form a developing agent image on the image carrier, and a casing having the plural developing units housed therein and including open sections partly exposing the developing agent-carrying members, an absolute value of the surface potential of said casing being not larger than 300 V;

a transfer section for transferring the developing agent image formed on the image carrier in the developing section; and a fixing section for fixing the transferred developing agent image.

2. The image-forming apparatus according to claim 1, wherein the casing of the developing units contains a conductive material.

3. The image-forming apparatus according to claim 2, wherein at least one material selected from the group consisting of a carbon fiber, a stainless steel fiber and a metal is used as the conductive material.

4. The image-forming apparatus according to claim 1, wherein the casing of the developing units is covered with a conductive material.

5. The image-forming apparatus according to claim 4, wherein the casing of the developing units is covered with a metal foil.

6. The image-forming apparatus according to claim 1, wherein the developing agent comprises toner particles containing a coloring agent and a binder resin, and at least one kind of an additive added to the surfaces of the toner particles and selected from the group consisting of titanium oxide subjected to a hydrophobic treatment and a metal oxide having a conductive surface treatment applied thereto.

7. The image-forming apparatus according to claim 1, wherein the rotary developing device includes a yellow color developing unit, a magenta color developing unit, and a cyan color developing unit, and the developing section further includes a black developing device.

8. The image-forming apparatus according to claim 1, wherein the casing constitutes a housing member formed integral with the developing units.

9. The image-forming apparatus according to claim 1, wherein a part of a surface of a toner cartridge container constitutes a part of the casing.

10. An image-forming method, comprising the steps of:

forming an electrostatic latent image on an image carrier;

arranging a rotary developing device, and the rotary developing device to permit one of a plurality of developing units to be positioned to face the image carrier to supply a developing agent onto the electrostatic latent image formed on the image carrier to form a developing agent image including a plurality of developing units each having a developing agent-carrying member for supplying the developing agent onto the electrostatic latent image formed on the image carrier, said plural developing units being arranged rotatable about an axis, and a casing holding the plural developing units and including open sections exposing partly the developing agent-carrying members of the developing units, an absolute value of the surface potential of the casing being not larger than 300 V;

transferring the developing agent image formed in a developing section onto a recording medium; and fixing the developing agent image transferred onto the recording medium.

11. The image-forming method according to claim 10, wherein the casing of the developing units contains a conductive material.

12. The image-forming method according to claim 11, wherein at least one material selected from the group consisting of a carbon fiber, a stainless steel fiber and a metal is used as the conductive material.

13. The image-forming method according to claim 10, wherein the casing of the developing units is covered with a conductive material.

14. The image-forming method according to claim 13, wherein the casing of the developing units is covered with a metal foil.

15. The image-forming method according to claim 10, wherein the developing agent comprises toner particles containing a coloring agent and a binder resin, and at least one kind of an additive added to the surfaces of the toner particles and one of titanium oxide subjected to a hydrophobic treatment and metal oxide having a conductive surface treatment applied thereto.

16. The image-forming method according to claim 10, wherein the rotary developing device includes a yellow color developing unit, a magenta color developing unit, and a cyan color developing unit, and the developing section further includes a black developing device.

17. The image-forming method according to claim 10, wherein the casing constitutes a housing member formed integral with the developing units.

18. The image-forming method according to claim 10, wherein a part of a surface of a toner cartridge container constitutes a part of the casing.

19. A developing apparatus comprising:

a rotary developing device including a plurality of developing units formed on the image carrier and arranged rotatable around an axis, each developing unit having a region for holding a developing agent and a developing agent-carrying member for supplying the developing agent onto an electrostatic latent image formed on the image carrier to form a developing agent image on the image carrier, and a casing having the plural developing units housed therein and including open sections partly exposing the developing agent-carrying members, an absolute value of the surface potential of said casing being not larger than 300 V.

* * * * *